US005839316A

United States Patent [19]

Kolivoski et al.

[11] Patent Number: 5,839,316

[45] Date of Patent: Nov. 24, 1998

[54] HAND-HELD CRIMPING TOOL

[75] Inventors: Christopher James Kolivoski, Harrisburg; Richard Lloyd Schaeffer, Jr., Carlisle; Michael Morris, Harrisburg, all of Pa.

[73] Assignee: The Whitaker Corporation, Wilmington, Del.

[21] Appl. No.: 863,724

[22] Filed: May 28, 1997

Related U.S. Application Data

[60] Provisional application No. 60/018,797 May 31, 1996.

[51] Int. Cl.[6] ..... H01R 43/042

[52] U.S. Cl. ..... 72/453.16; 72/452.8; 81/313

[58] Field of Search ..... 72/453.16, 452.8, 72/452.9, 407, 409.1; 29/751, 753, 237; 81/313, 345

[56] References Cited

U.S. PATENT DOCUMENTS

| | | | |
|---|---|---|---|
| 2,897,703 | 8/1959 | Fischer | 72/453.16 |
| 2,931,260 | 4/1960 | Townshend | 81/313 |
| 2,942,507 | 6/1960 | Fischer | 72/409.1 |
| 2,974,551 | 3/1961 | Powell | 81/313 |
| 3,492,854 | 2/1970 | Eppler | 72/452.8 |
| 3,672,193 | 6/1972 | Schiller | 81/313 |
| 3,769,859 | 11/1973 | Sykes | 81/313 |
| 4,109,504 | 8/1978 | Rommel | 72/453.16 |

*Primary Examiner*—Daniel C. Crane
*Attorney, Agent, or Firm*—Marshall E. Rosenberg

[57] ABSTRACT

A hand-held crimping tool is disclosed having an air cylinder which retains thereto a head member, and has a moveable piston which is attached to a cam member. The cam member is receivable through the head member, and a crimping tool is fixed to the head member, whereby the cam member is cooperable with the crimping tool to move die surfaces towards one another for the crimping actuation of a wire terminal. The head member includes a pawl assembly, whereby the pawl member is cooperable with a ratchet surface provided on the cam member, whereby the cooperation of the ratchet and pawl determines the axial movement of the cam member relative to the head member, which also determines the crimping force exerted on the terminals to be crimped.

7 Claims, 6 Drawing Sheets

HAND-HELD CRIMPING TOOL

FIELD OF THE INVENTION

This application claims the benefit of U.S. Provisional application Ser. No. 60/018,797, Filed May 31, 1996.

The subject of the invention relates to an improved air actuable hand tool for crimping stripped wire conductors to electrical terminals.

SUMMARY OF THE PRIOR ART

It is common in the electrical connector industry to have hand-held tools for crimping stripped wires to electrical contacts. Such hand tools normally provide means for accentuating the mechanical advantage from the user to the crimping head of the tool to provide a large force at the crimping dies to effect the crimped connection between the terminal and the stripped conductor.

One such type of hand tool is shown in FIG. 1, which includes an air actuated piston cylinder, interconnected to a camming member, which actuates a pair of scissor-type jaws, whereby the jaws close at the forward end of the dies effect the crimping force to the terminal. Such a hand tool is commercially available from AMP Incorporated under the name Certi-Crimp. An advantage of the system shown in FIG. 1, is that the interaction between the cam member and the scissor jaws provides a high mechanical advantage to the jaws thereby effecting high crimping force in relation to the input pressure of the piston. While this crimping system is effective for most applications, improvements to the system can be made.

The present system utilizes a magnetic proximity sensor to locate the travel of the piston in the air cylinder to determine the crimp force required at the crimping heads, which provides two shortcomings. Firstly, the magnetic switch requires that the hand tool have two inputs, one pneumatic and the other electric to control the hand tool. This requires that the facility using such a hand tool have the requisite supply lines. Secondly, the magnetic proximity switch, while it is operable to detect the positioning of the air piston, which in effect gives the closed crimp dimension, it is difficult to approximate the axial position of the proximity switch for various crimp heights and wire gauges.

SUMMARY OF THE INVENTION

The object of the invention is to provide a pneumatic hand tool which has an improved crimp dimension detector, having an improved sensitivity over its axial dimension.

A further object of the invention is to provide a crimp height detector which is mechanical in nature rather than electrical.

The objects of the invention have been accomplished by providing a hand operable tool for crimping terminals onto conductors including a linear actuator having an armature, a head member attached to the linear actuator, and a cam member coupled to the armature and movable within the head in a forward direction to a specific position to effect the crimping and in a reverse direction. A crimping tool is coupled to the head member and operated by the cam member during movement thereof in the forward direction. A detection assembly is coupled to the head member for detecting the specific position of the cam member as the cam member is undergoing movement in the forward direction. The detector assembly allows movement of the cam member in the reverse direction only upon the cam member reaching the specific position. The detection assembly includes a plate coupled to the head and a ratchet and mating pawl, one of which is coupled to the head and the other of which is coupled to and carried by the plate. The plate is selectively movable in the forward and reverse directions to provide variable specific positions detecting the correct axial position of the cam member, the assembly being attached to the head member to detect the axial position of the cam and release the cam from further forward movement.

The following invention will now be described by reference to the drawing figures, FIG. 1 shows the prior art hand tool;

DETAILED DESCRIPTION OF THE INVENTION

Figure 1:
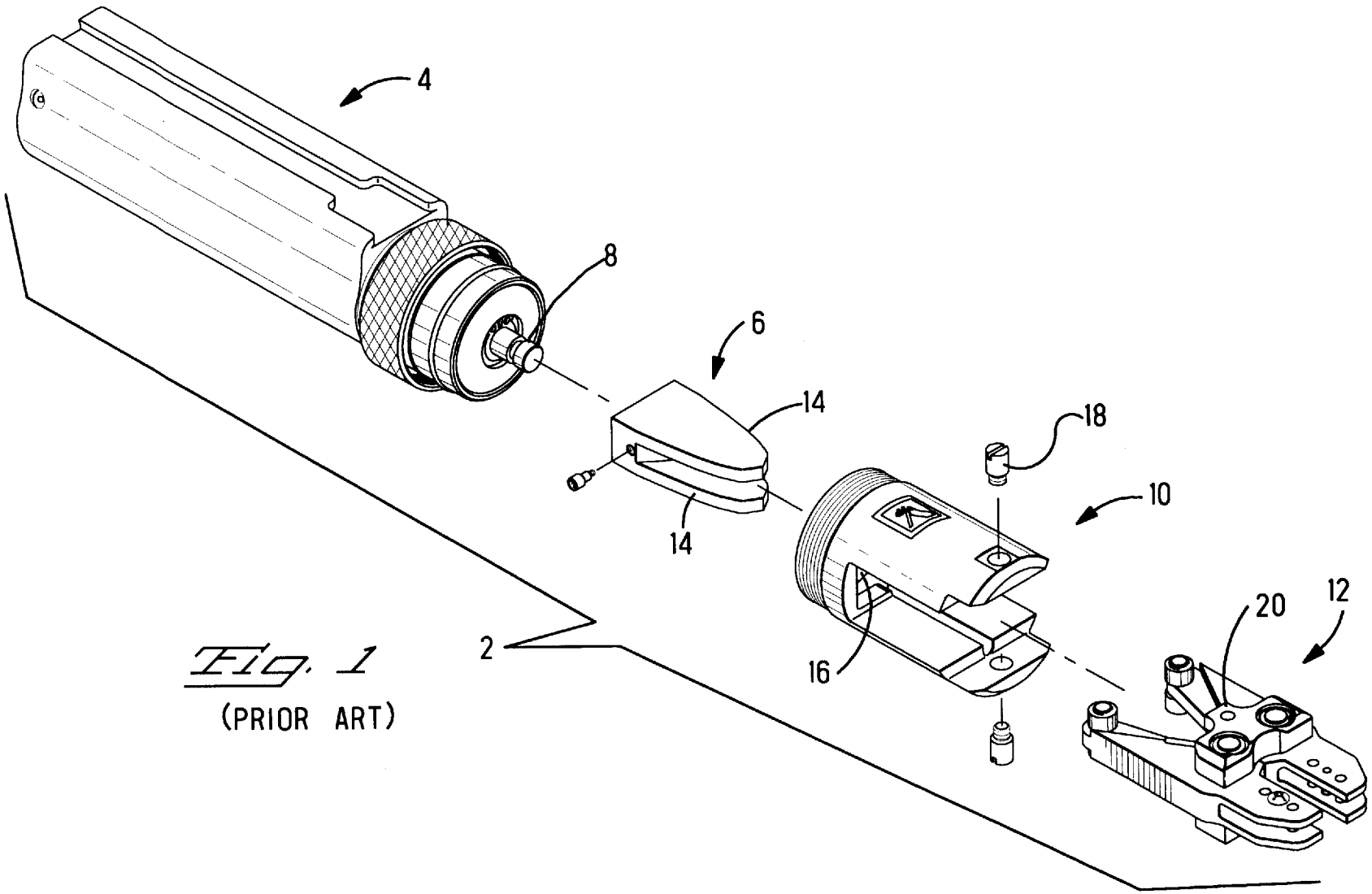
FIG. 1 (PRIOR ART)

With reference first to FIG. 1, a prior art pneumatic hand tool for crimping terminals to stripped conductors is comprised of a pneumatic hand-held cylinder 4 interconnected to a cam member 6 via a dual-acting air piston 8. A tool head 10 is fixed to the cylinder 4 and carries the die tool 12 for effecting the crimping process. More specifically, the hand cylinder 4 has a piston 8 which is interconnected to the rear face of the camming member 6 by known means, such as a set screw interconnecting the two members together. The cam member 6 includes camming surfaces 14 at the leading side thereof, which project through an opening 16 of the head member 10, and cooperate with rollers on the die tool 12. The die tool 12 is fixedly retained to the head member 10 for example by set screws 18 which cooperate with threaded holes 20 on the tool member 12. With respect now to FIG. 2 and 3, the improved tool will be described, it being understood that the existing cylinder 4 and crimping tool 12 be utilized therewith, the improvements hereto relating to the camming member 6 and head 10 as described herein.

Figure 2:
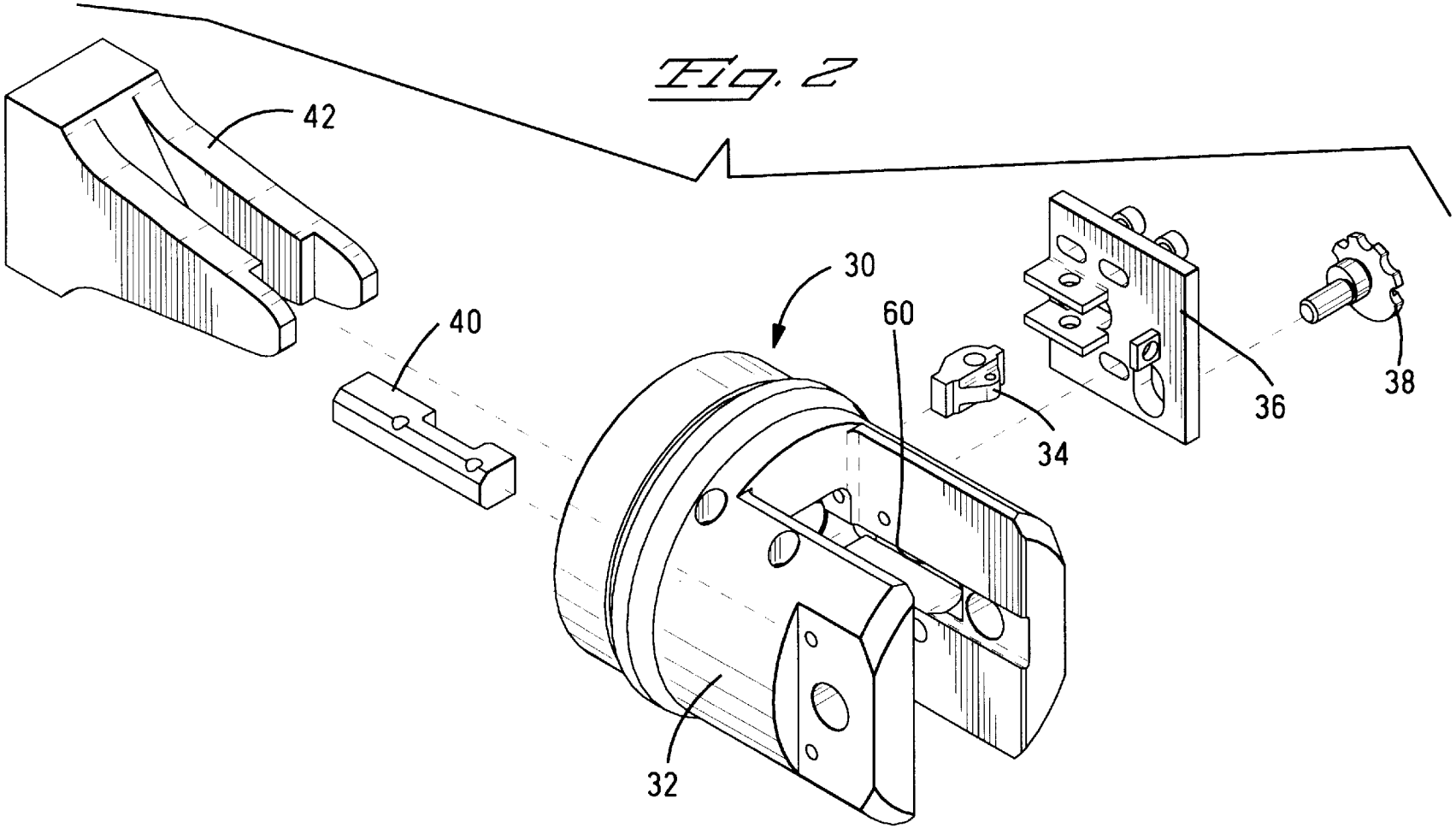
FIG. 2 shows an isometric view of the improved head and cam members.

With respect now to FIG. 2, an improved head assembly is shown as 30 which is comprised of a head member 32, an adjusting assembly 36, an eccentric adjusting mechanism 38, an insert 40, and a camming member 42. With respect to FIG. 3, the head 32 is comprised of a cylindrical section 44, which can be externally threaded for interconnection to the cylinder 4. The head 32 is further comprised of a slot portion 46, which slot portion defines two wall sections 48 and 50. It should be understood that the slot portion 46 is profiled to accept a crimping tool member similar to item 12 shown in FIG. 1. It should also be appreciated that apertures at 52 are provided in each of the walls 48 and 50 to accommodate retaining means to hold the crimping tool in place, similarly as in FIG. 1.

The head 32 further comprises a flattened surface 54 having an enlarged aperture 56, four threaded apertures 58 and a slotted opening at 60, which as shown in comparison to FIG. 2, shows that the slot extends entirely through the wall member 50 for purposes to be described herein.

Figure 3:
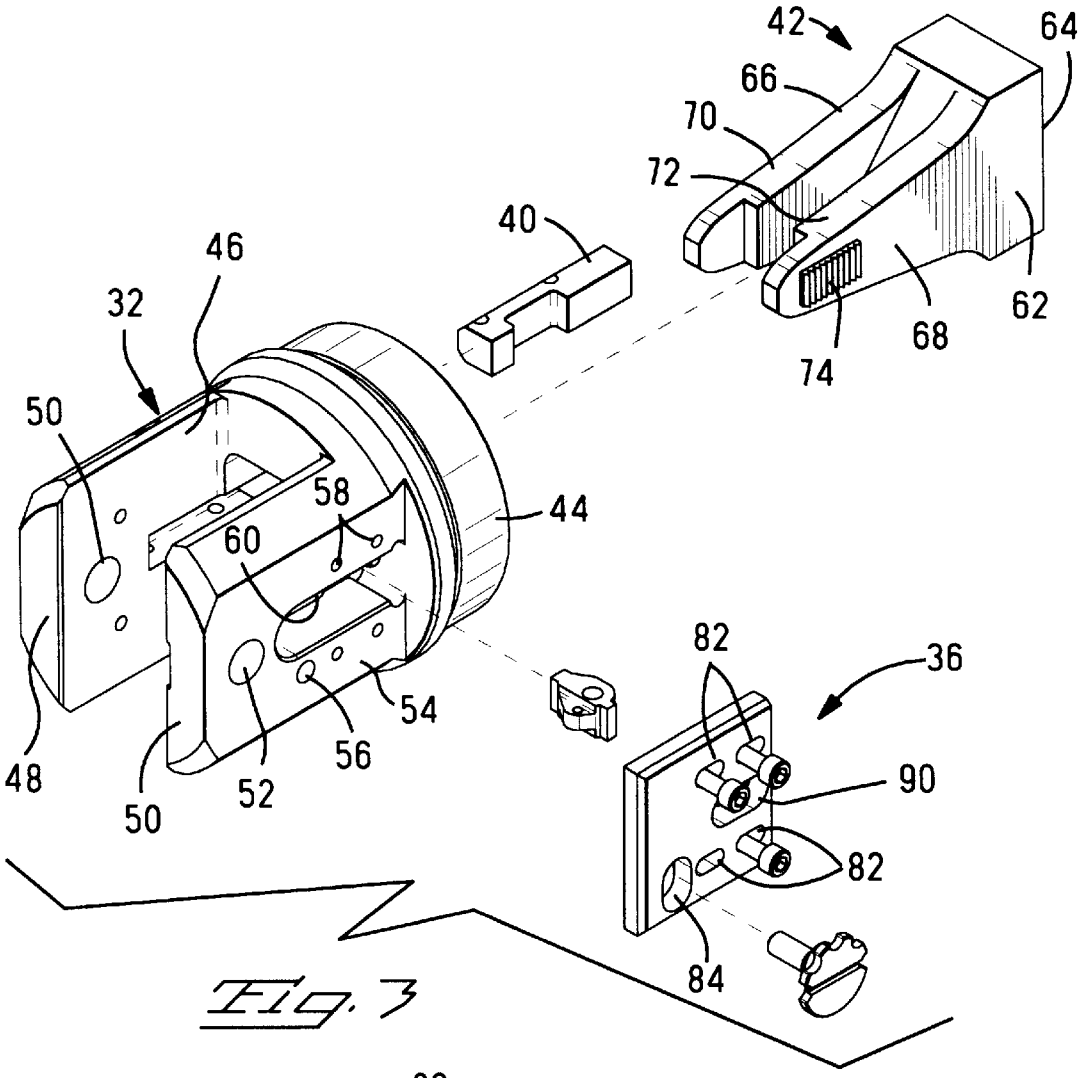
FIG. 3 shows the improved head and cam member from a different perspective.

With reference still to FIG. 3, the camming member 42 is shown having a body section 62 with a rear surface 64, which, as should be appreciated, contains an aperture for containment onto the piston rod 8 of the tool 4. The camming member 42 further comprises two wall sections 66 and 68 which comprise camming surfaces 70 and 72. The wall 68 further comprises a ratchet section 74 on the side surface thereof which will be described in greater detail herein.

Figure 4:
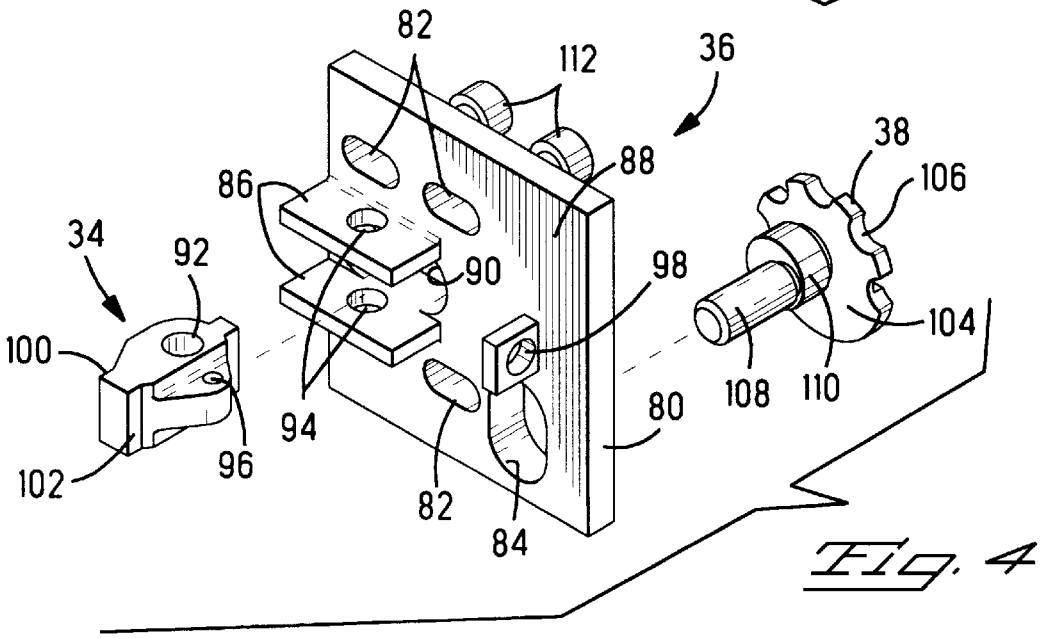
FIG. 4 shows an enlarged view of the pawl assembly.

With respect now to FIG. 4, the adjusting assembly 36 is comprised of a plate member 80 which includes four longitudinally elongate apertures 82, and a transversely elongate aperture 84. Two wall sections 86 extend downwardly from a lower surface 88 of the plate section, and flank a slotted opening at 90. The pawl member 34 is profiled to be received between the two wall members 86, to a position where the aperture 92 of the pawl member is aligned with apertures 94 of the wall members 86. While not shown, it should be appreciated that a pin member is insertable through the apertures 94 and 92 to retain the pawl member 34 in place. The pawl member 34 further comprises an aperture 96 which can receive a tension spring, the opposite end of which can be clipped to the aperture 98 to hold the pawl member in spring load. Furthermore, the pawl member 34 includes a first engaging surface 100 and a second engaging surface 102 as will be described herein.

Finally with respect to FIG. 4, the eccentric adjusting member 38 is comprised of a cylindrical wheel member 104 having a plurality of detent notches 106, a shaft member 108 which is profiled to be received in the aperture 56, and an eccentric member 110 which is received through the transverse slot 84.

With the above described components, the assembly of the tool will now be described. Firstly, the pawl 34 is assembled as described to the plate member 36, and the set screws 112 hold the plate member 80 to the flat surface 54 of wall member 50. This positions the pawl member 34 within the slot 60. The eccentric member 38 can be positioned through the transverse slot 84 such that the shaft 108 is positioned in the aperture 56, and the eccentric portion 110 is positioned in the transverse slot 84. It should be appreciated that the slot and eccentric are profiled such that the eccentric can rotate within the transverse slot to not urge the plate in a transverse direction, but that the width of the slot, that is the short dimension of the slot is just slightly larger than the eccentric such that if the eccentric is rotated, the plate is moved axially.

Figure 5:
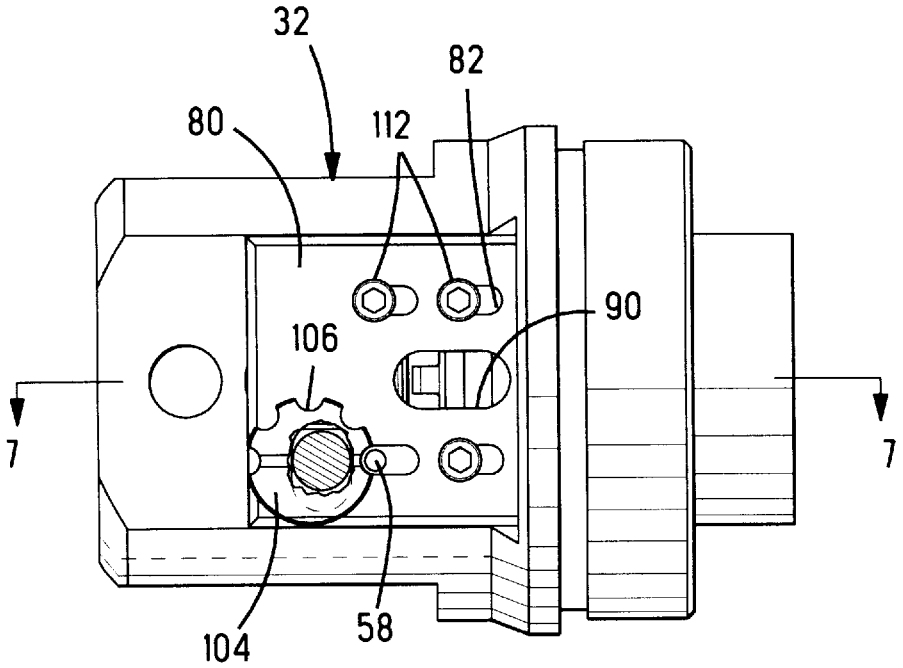
FIGS. 5 and 6 show extreme positions of the pawl assembly relative to the head member.
Figure 6:
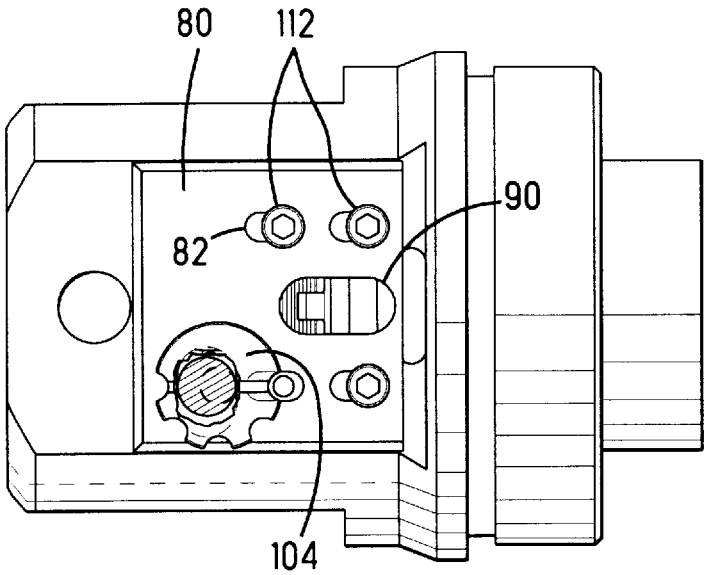

This is shown more clearly in FIGS. 5 and 6 where the plate member 80 is shown in its two extremes. In FIG. 5, the eccentric is rotated to the full right position such that the plate is allowed to move to its extreme right (as viewed in FIG. 5) such that the screws 112 are positioned to the left most position in the elongate slots 82; whereas in FIG. 6 the eccentric is rotated to the full left position such that the plate is moved to the full left by way of the eccentric, such that the screws 112 are positioned at the right most section of the slots 82. It should be appreciated that this adjusting is accommodated by way of the detent members 106 being aligned with the tapped aperture 58 to receive its own screw. This position of the plate positions the pawl member axially relative to the ratchet member 74, the purpose of which will be described in greater detail herein.

With respect now to FIGS. 7A through FIG. 7D, the operation of the cam relative to the head will be described herein. With respect first to FIG. 7A, the cam member 42 is shown in the starting position, fully retracted, with the ratchet section 74 spaced away from the first pawl surface 100. It should be appreciated that upon activation of the air cylinder, that the cam member 42 moves rightwardly as viewed in FIG. 7A to the position of 7B, where the first pawl surface 100 begins to cooperated with the ratchet teeth 74. It should also be appreciated that due to the air cylinder being dual acting, when the operator disengages the hand switch, or foot pedal, of the air cylinder, the piston attempts to retract. It is therefore the pawl and ratchet which retains the cam in place. It should also be appreciated that repetitive actuations and deactivations of the air cylinder are made to complete the crimping cycles.

Figure 7A:
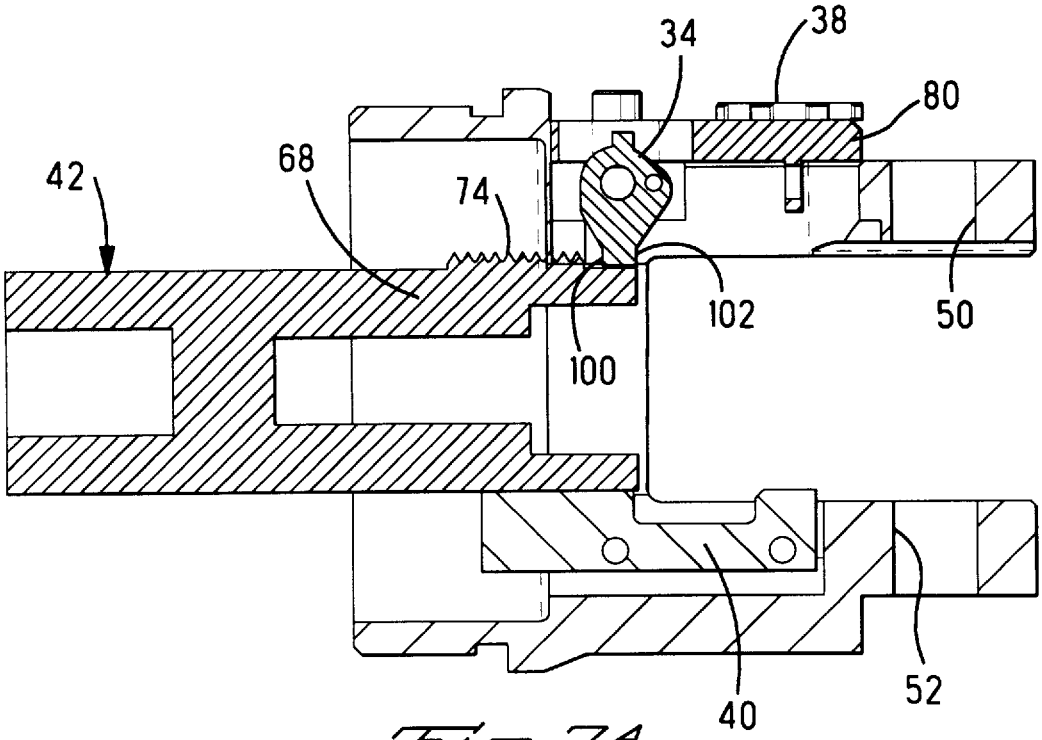
FIGS. 7A–7D show the operation of the ratchet and pawl mechanism through a complete cycle.
Figure 7B:
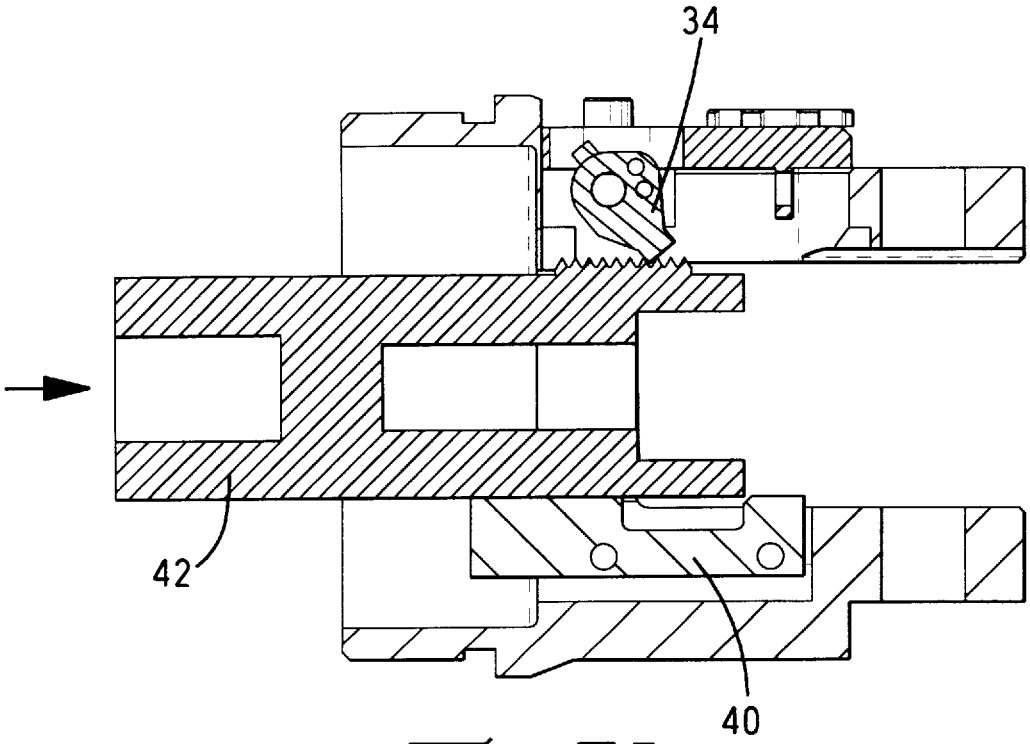
Figure 7C:
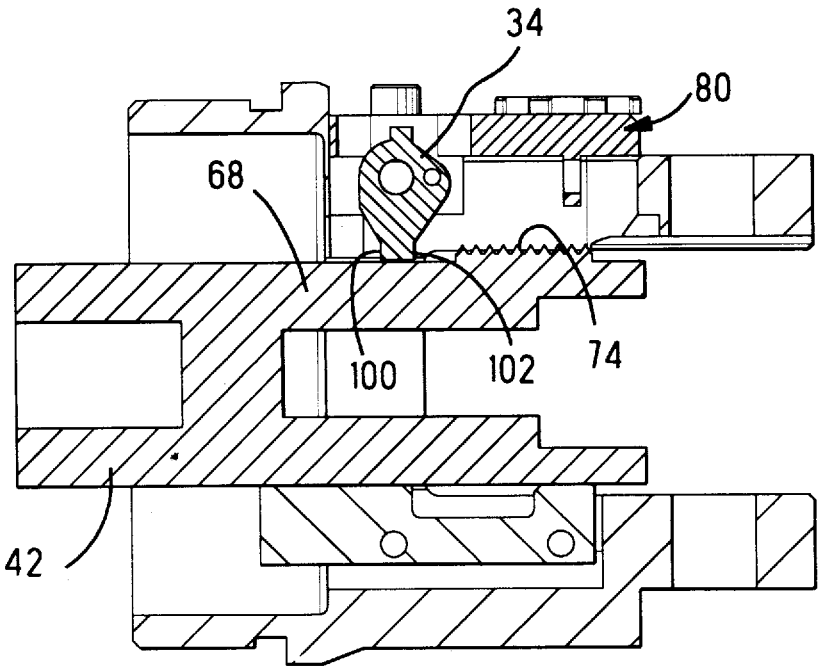
Figure 7D:
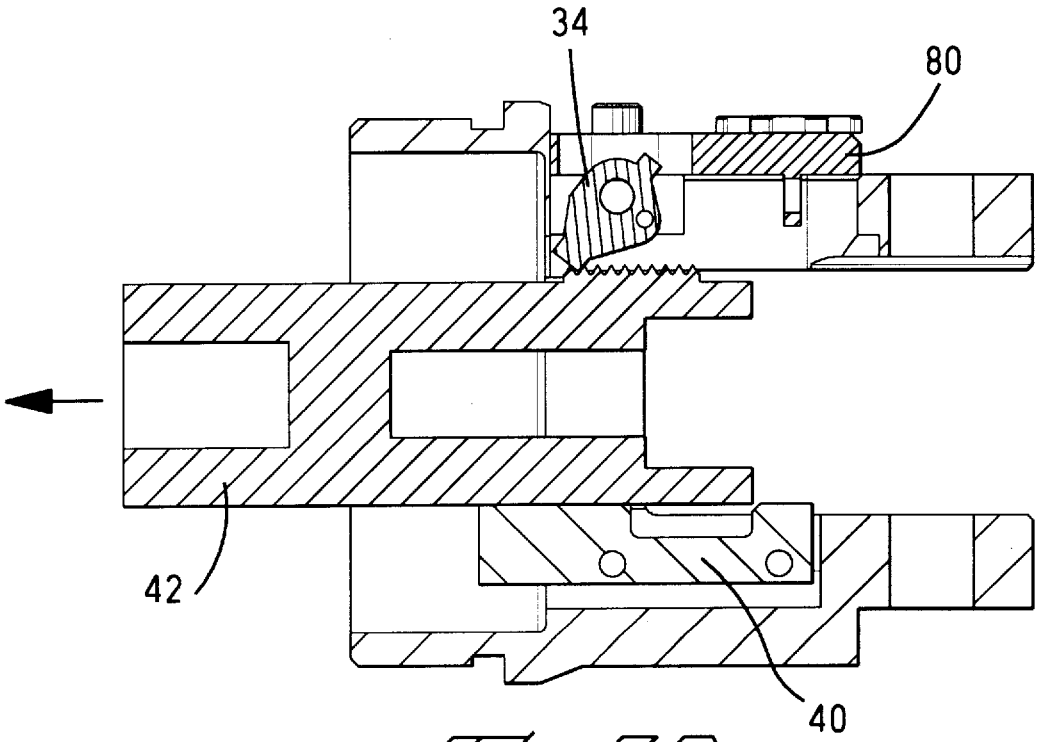

Continual cycling of air pressure on the cylinder 4 causes the continued rightward movement of the cam member 42 to the position shown in FIG. 7C, where the ratchet member 74 clears the pawl member 34. At this position, the cam surfaces 70 and 72 will have closed the die member 12 to its fully crimped position, and the discontinuance of the air on the cylinder will cause an automatic retraction of the cam member 42 to the left such that the ratchet member 74 ratchets past the pawl member, causing the pawl member to rotate in the opposite sense as shown in FIG. 7D, whereupon it will return again to the position shown in FIG. 7A.

It should be appreciated that the longitudinal positioning of the pawl member, will effect the specific longitudinal position of the cam member 42 at which point it retracts, and thereby effects the dimension between the crimping dies of the crimping tool 12. It should also be remembered that the longitudinal positioning of the pawl member 34 is accommodated by the position of the eccentric member as previously described with respect to FIGS. 5 and 6.

We claim:

1. In a hand operable tool for crimping terminals to conductors including a linear actuator having an armature; a head member attached to said linear actuator; a cam member coupled to said armature and movable within said head by said armature in a forward direction to a specific position to effect said crimping and in a reverse direction; a crimping tool coupled to said head member and operated by said cam member during movement thereof in said forward direction, a detection assembly coupled to said head member for detecting said specific position of said cam member as said cam member is undergoing movement in said forward direction, allowing movement of said cam member in said reverse direction only upon said cam member reaching said specific position, wherein said detection assembly comprises:

(a) a plate coupled to said head;

(b) a ratchet and mating pawl, one of which is coupled to said head and the other of which is coupled to and carried by said plate, wherein said plate is selectively movable in said forward and reverse directions to provide variable specific positions.

2. The tool according to claim 1 wherein said ratchet is coupled to and carried by said cam member.

3. The tool according to claim 2 wherein said ratchet is on a side surface of said cam member.

4. The tool according to claim 3 wherein said pawl is coupled to and carried by said plate.

5. The tool according to claim 1 including an eccentric member cooperable with said plate for effecting said variable specific positions.

6. The tool according to claim 5 wherein said eccentric member includes a plurality of detent positions, each of which provides a respective one of said variable specific positions.

7. The tool according to claim 1 wherein said linear actuator is an air cylinder and said armature is a piston rod of said air cylinder.

* * * * *